United States Patent [19]

Takahashi et al.

[11] Patent Number: 4,580,736

[45] Date of Patent: Apr. 8, 1986

[54] CAGE MILL

[75] Inventors: Hidekazu Takahashi, Tokyo; Junya Yamano, Togane; Sousuke Naito, Osaka; Toshio Watanabe, Tokyo; Tomeyoshi Nakajo, Tochigi, all of Japan

[73] Assignees: Toshiba Ceramics Co., Ltd., Tokyo; Kansai Zyari Kabushiki-Kaisha, Osaka; Otsuka Iron Works, Ltd., Tokyo, all of Japan

[21] Appl. No.: 683,161

[22] Filed: Dec. 18, 1984

[30] Foreign Application Priority Data

Dec. 29, 1983 [JP] Japan ..... 58-248015
Dec. 29, 1983 [JP] Japan ..... 58-248016

[51] Int. Cl.[4] ..... B02C 7/04; B02C 13/20

[52] U.S. Cl. ..... 241/188 A; 241/195; 241/197

[58] Field of Search ..... 241/188 A, 188 R, 195, 241/197

[56] References Cited

FOREIGN PATENT DOCUMENTS 48-33055 10/1973 Japan .

OTHER PUBLICATIONS

Catalog No. 608-R "New G Series Cage Mills" Stedman.

*Primary Examiner*—Howard N. Goldberg
*Assistant Examiner*—Timothy V. Eley
*Attorney, Agent, or Firm*—Pahl, Lorusso & Loud

[57] ABSTRACT

A cage mill includes a housing having an inlet at a side portion thereof and an exit at a lower portion thereof, a disc rotatably arranged within the housing, a plurality of support shafts fixed at one end thereof to the disc so as to form a cage into which hard materials can enter through the inlet of the housing when the cage rotates as a rotor, a ring fixed to the other end of the support shafts, a plurality of ceramic pins each fixed by way of an adhesive to each of the support shafts, and a stopper mechanism for preventing the ceramic pins from directly contacting the disc and the ring.

14 Claims, 16 Drawing Figures

CAGE MILL

BACKGROUND OF THE INVENTION

This invention relates to an improved cage mill which can crush, grind, pulverize, blend and mix hard materials such as stone.

A conventional mill has a housing, a disc placed in the housing and a plurality of cage pins attached to the disc so as to form a cage type rotor. The rotor rotates so as to crush the hard materials by crushing the hard materials against the cage pins. One example of such a cage mill is disclosed in the Japanese Patent Publication No. 48-33055.

In such conventional cage mills, a portion of a cage which is apt to be worn is made of a high chrome steel. The conventional mills having high chrome steel bars can be used only for a short period of time and, therefore, the running cost is very high. In particular, if the pins function as a rotor, they are subject to strong wear because the pins are directly in contact with the hard materials.

SUMMARY OF THE INVENTION

An object of this invention is to provide an improved cage mill which can operate for a long period of time at a peak efficiency.

A further object of this invention is to provide a cage mill in which maintenance is convenient.

According to this invention, there is provided a cage mill including a housing having an inlet at a side portion thereof and an exit at a lower portion thereof, a disc rotatably arranged within the housing, a plurality of support shafts fixed at one end thereof to the disc so as to form a cage into which hard materials can enter through the inlet of the housing when the cage rotates as a rotor, a ring fixed to the other end of the support shafts, a plurality of ceramic pins, each fixed by way of an adhesive to each of the support shafts, and a stopper mechanism for preventing the ceramic pins from directly contacting the disc and the ring.

In preferred embodiments of this invention, first and second linings made of ceramics are fixed to the disc and the ring for protecting the disc and the ring, respectively. The first and second linings have a channel-shaped portion or a L-shaped portion in section corresponding to a configuration of the ring and the disc for covering an inner surface of the disc and the ring. The first and second linings have plural holes for arranging the support shafts, and a clearance of, for instance, 1 to 3 mm is formed between the first and second linings and each ceramic pins.

Preferably, at least a pair of small and large cages is arranged within the housing in such a manner that the cages rotate in opposite directions to each other.

The ceramic pins are made of sintered silicon nitride ($Si_3N_4$), sintered aluminus porcelain, or sintered silicon carbide(SiC).

According to this invention, various embodiments of the stopper mechanism can be employed. For instance, a recess is formed at both ends of the ceramic pins and a spacer is fixedly disposed in the recess between the ceramic pins and the disc as well as between each ceramic pin and the ring. The spacer may be detachably disposed in the recess.

In another embodiment, the support shafts are formed in a pipe shape and have at both ends thereof a female screw portion. A bolt is screwed with a female screw of the disc and the female screw portion of the support shafts so that the shafts are fixed to the disc with a clearance. Also, a bolt is screwed to a female screw portion of the ring and the female screw portion of the support shaft so that the ring is fixed to the support shafts with a clearance.

In a further embodiment of this invention, pipes are disposed between the ceramic pins and the support shafts and are supported at both ends thereof by the support shafts. The pipes slightly project from the end surfaces of the ceramic pins and contact the disc and the ring.

In still another embodiment of this invention, the support shafts have at both ends a small diameter portion on which a washer is placed so as to form the stopper mechanism.

Pipes can be provided between the support shafts and the ceramic shafts which will slightly protrude from the end surfaces of the ceramic pins.

DESCRIPTION OF THE PREFERRED EMBODIMENTS

Figure 1:
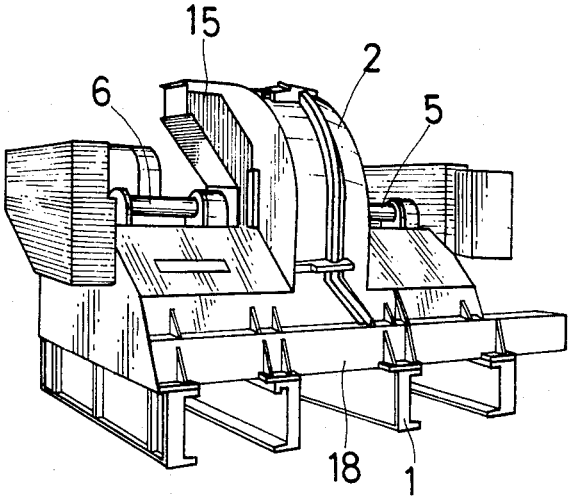
FIG. 1 is a schematic perspective view showing a cage mill according to a preferred embodiment of this invention.
Figure 2:
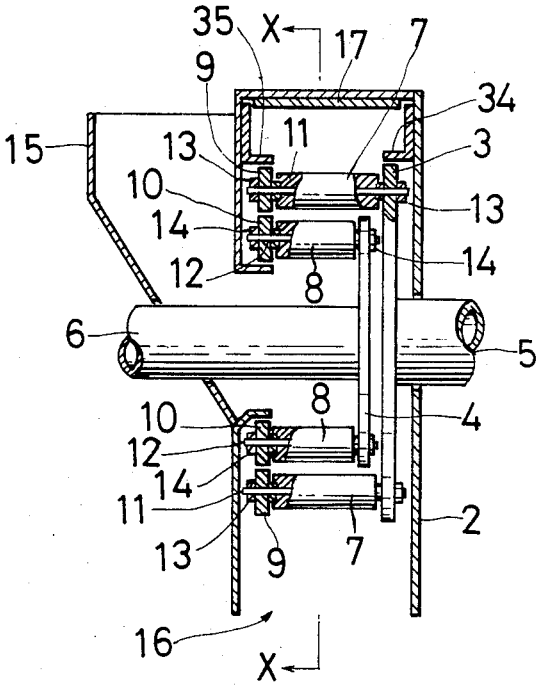
FIG. 2 shows a vertical section of an inside portion of the cage mill shown in FIG. 1.

Referring now to FIG. 1, a cage mill has a base 1 to which a housing 2 is attached by way of a frame 18. As shown in FIG. 2, two discs 3, 4 are coaxially arranged within the housing 2. A central portion of the disc 3 is connected to a driving shaft 5. A central portion of the other disc 4 is connected to another driving shaft 6. The driving shafts 5 and 6 are rotatably supported by bearing means (not shown) and designed to be driven by electric motors (not shown), respectively, in such a manner that the driving shafts 5, 6 rotate in the opposite directions in a conventional manner.

A plurality of ceramic pins 7 and 8 are arranged along the periphery of the discs 3 and 4 at regular intervals so as to form a large cage and a small cage, respectively. A ring 9 is attached to an outer end portion of each of the ceramic cage pins 7. Another ring 10 is attached to an outer end portion of each ceramic pins 8. The diameter of the ring 9 is larger than that of the ring 10. Each of the ceramic pins 7, 8 has a through-hole formed in the central portion thereof. Support shafts 11 and 12 penetrate through the through-holes of the ceramic pins 7, 8, respectively.

The shafts 11, 12 are fixed at one end thereof to the discs 3, 4 by means of nuts 13, 14. The shafts 11, 12 pass through the respective holes of the rings 9, 10 and project slightly therefrom so as to engage the nuts 13, 14 whereby the rings 9, 10 can be fixed to the shafts 11,12.

As later explained in detail, a clearance "S" (for example, 1 to 3 mm) is formed at both ends of the ceramic pins 7, 8 so that the ceramic pins 7, 8 do not directly contact the discs 3, 4, the rings 9, 10 and so on.

The plural ceramic pins 7 constitute a first cage type rotor while the plural ceramic pins 8 constitute a second cage type rotor. The large size disc 3 and the ceramic pins 7 attached thereto constitute a large cage while a small size disc 4 and the ceramic pins 8 attached thereto constitute a small cage.

Figure 3:
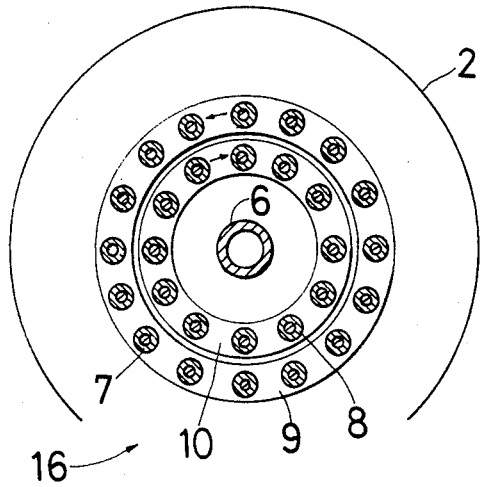
FIG. 3 is a schematic sectional view taken along the X—X line of FIG. 2.
Figure 14:
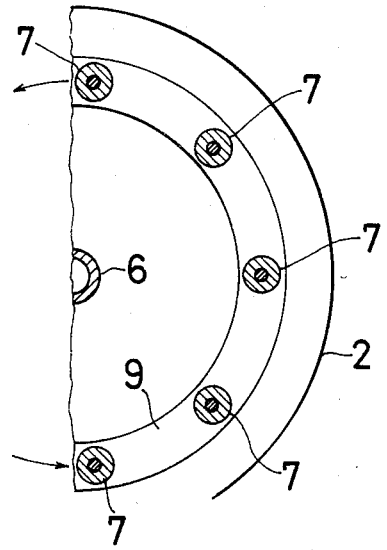
FIG. 14 is a schematic sectional view showing a single cage type cage mill.

Although in the embodiment of FIGS. 2 and 3 two cages are employed, this invention is not limited to such an embodiment. For instance, this invention can be applied to a cage mill having one cage (FIG. 14), four cages (FIG. 15), or six cages(FIG. 16). As shown by the arrows, the cages having the ceramic pins 7 and the ring 9 and the cages having the ceramic pins 8 and the ring 10 rotate in the opposite directions.

Generally speaking, as the desired size of the final crushed product becomes smaller, the required number of cages increases. Also, a variety of product gradations can be easily altered by changing the speed of the cage mill.

A housing 2 houses all cages. A plurality of covers 34, 35 are provided so as to protect the housing 2. The braker plates 17 which are placed in the housing 2 are preferably made of ceramics.

In operation, the hard materials are inserted through a hopper 15 into a central portion of the smallest cage near the driving shaft 6. The hard materials are first crushed by the ceramic pins 8 and move outwardly. Such crushed materials are further crushed by the ceramic pins 7. Finally the materials move outwardly from the ceramic pins 7 so that they are crushed by the braker plates 17 so as to become the final crushed product. Thereafter, such the final crushed product falls by gravity through an exit 16 of the housing 2.

According to this invention, the support shafts 11, 12 are substantially covered by the ceramic pins 7, 8. A stopper, e.g. spacer 21, is provided at each ceramic pins 7, 8 so as to form a clearance S between both ends of each of the ceramic pins 7, 8 and adjacent members such as the discs 3, 4 and the rings 9, 10.

Referring to FIGS. 4 to 9, various embodiments of a large cage will be explained in detail, which can be also applied to a small cage.

Figure 4:
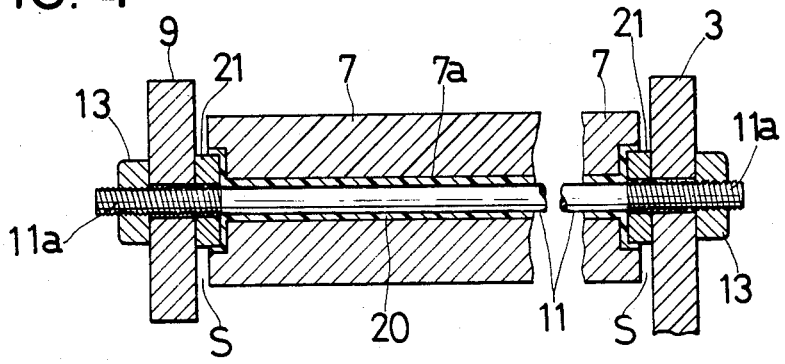
FIG. 4 is an enlarged sectional view showing a pin and its related members shown in FIG. 2.

In the embodiment of FIG. 4, a through-hole 7*a* is formed in a center portion of each ceramic pin 7. The support shaft 11 is inserted into the through-hole 7*a* of the ceramic pin 7 and fixed thereto by the adhesive 20. A male screw 11*a* is formed at both end portions of the support shaft 11. A small cylindrical recess for a spacer 21 is formed at each end of the ceramic pin 7. The adhesive 20 is also provided between the spacer 21 and the recesses of the ceramic pin 7. The spacers 21 function as the stopper mechanism. Thus, a clearance S is formed between the disc 3 and the ceramic pin 7, and a clearance S is also formed between the ring 9 and the ceramic pin 7.

The ring 9 is fixed between the nut 13 and the spacer 21 by the nut 13 engaging with the male screw 11*a* of the support shaft 11.

The spacer 21 at the disc 3 is fixed to the recess of the ceramic pin 7.

An example of the adhesive 20 is an epoxide resin. Any other binders can be used as the adhesive 20.

If the adhesive 20 is provided between the support shaft and the ceramic pin, the impact on the ceramic pins 7, 8 can be absorbed so as to prevent the ceramic from cracking.

Figure 5:
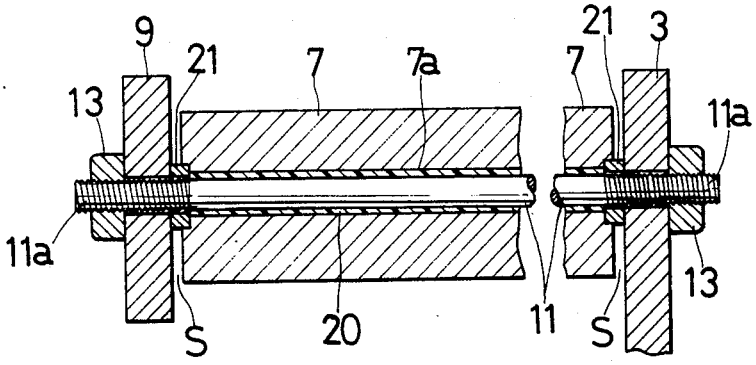
FIGS. 5 through 9 show other various embodiments of this invention, corresponding to FIG. 4.

The embodiment of FIG. 5 is similar to the embodiment of FIG. 4 except for the fact that the adhesive 20 is not provided between the spacer 21 and the ceramic pin 7. The ceramic pin 7 directly contacts the spacer 21 so that the spacer 21 can be easily detached from the support shaft 11, if desired. In this embodiment, the spacer 21 can be conveniently exchanged for a new one. The thickness of the spacer 21 can be changed in order to adjust the clearance S.

Figure 6:
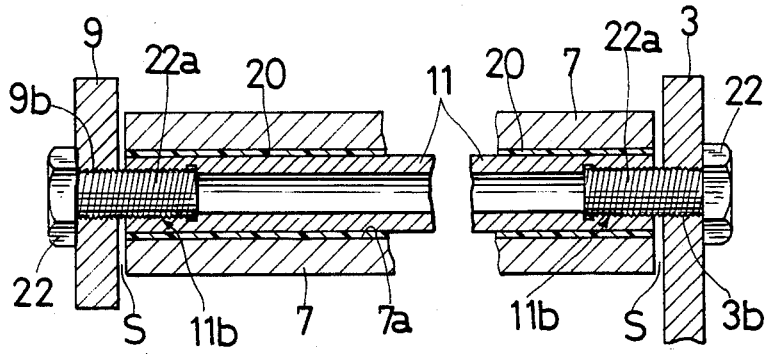

In the embodiment of FIG. 6, the support shaft 11 is formed in a pipe shape and has a step portion at both end portions thereof on which a female screw 11*b* is formed. A male screw portion 22*a* of a bolt 22 is screwed into the female screw 11*b* of the support shaft 11 and a female screw portion 3*b* of the disc 3. Also, a female screw 11*b* of another bolt 22 is screwed into the other female screw 11*b* of the support shaft 11 and a female screw portion 9*b* of the ring 9. The clearance S is formed between the disc 3 and the ceramic pin 7 as well as between the ring 9 and the ceramic pin 7. The adhesive 20 is placed between the through-hole 7*a* of the ceramic pin 7 and the support shaft 11 thereby to fix the ceramic pin 7 to the support shaft 11.

Figure 7:
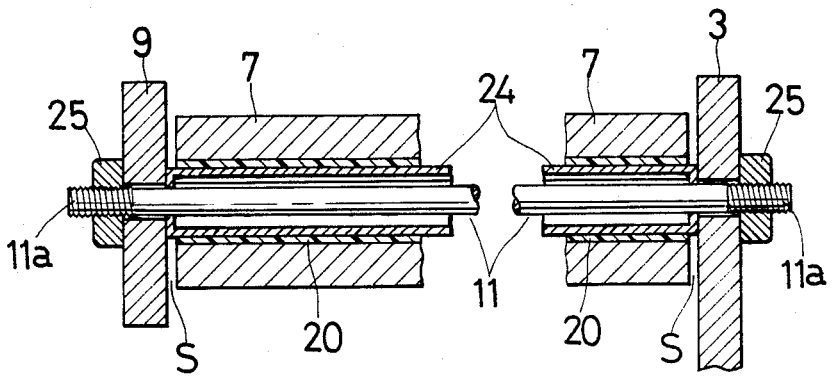

In the embodiment of FIG. 7, a pipe 24 is disposed between the ceramic pin 7 and the support shaft 11. The ceramic pin 7 is fixed to the pipe 24 by means of the adhesive 20. The pipe 24 is supported at its ends by the support shaft 11. When a nut 25 is screwed with the male screw portion 11*a* of the support shaft 11 at both ends of the pipe 24, the pipe 24 is pressed by and fixed between the disc 3 and the ring 9. Both ends of the pipe 24 slightly project from the opposite end faces of the ceramic pin 7 so as to form a clearance S between the ceramic pin 7 and the disc 3 as well as between the ring 9 and the ceramic pin 7.

Figure 8:
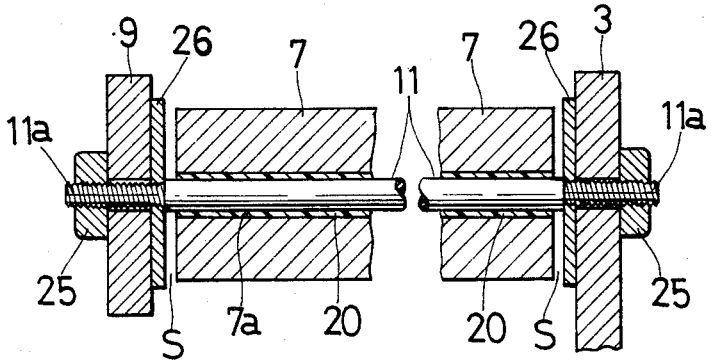

In the embodiment of FIG. 8, the ceramic pin 7 is fixed to the support shaft 11 by means of the adhesive 20. Both end portions of the support shaft 11 are formed in a step shape so as to form a small diameter portion on which a male screw 11*a* is formed. After the male screw portion 11*a* of the support shaft 11 is inserted into the washer 26 and the disc 3, the nut 25 is screwed thereto whereby the shaft 11 can be fixed to the disc 3. The other male screw portion 11*a* of the support shaft 11 is inserted into the washer 26 and the ring 9 and then screwed with the nut 25 so that the ring 9 is fixed to the support shaft 11. In this embodiment, also, a clearance S is formed between the washer 26 and the ceramic pin 7.

Figure 9:
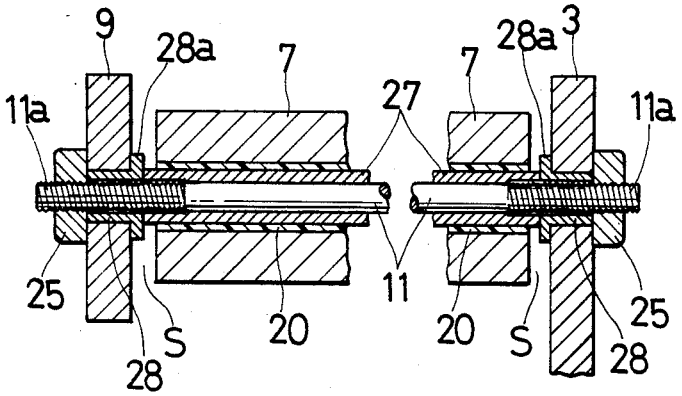

In the embodiment of FIG. 9, a pipe 27 is provided between the ceramic pin 7 and the support shaft 11. The adhesive 20 is provided between the pipe 27 and the ceramic pin 7 so that the ceramic pin 7 is fixed to the pipe 27. A male screw 11*a* is formed on each end portion of the support shaft 11. The male screw 11*a* of the support shaft 11 is inserted into a sleeve 28 having a flange portion 28*a* at its inner edge. The sleeves 28 are inserted into the respective holes of the ring 9 and the disc 3. The nuts 25 are screwed to the male screws 11*a* of the support shaft 11. Thus, the ring 9 and the disc 3 are fixed between the flange portion 28*a* of the sleeve 28 and the nut 25. As the pipe 27 slightly projects from both end faces of the ceramic pin 7, a clearance S is formed at both ends of the ceramic pin 7. In a cage mill, the disc 3 is positioned at a driving side while the ring 9 is positioned at a driven side. In other words, the ring 9 is driven by the disc 3 by way of the support shaft 11. As a result, a torsional moment is produced in the support shaft 11. However, if the support shaft 11 is made of a metal, such a torsional moment can be absorbed thereby. Also, the adhesive 20 absorbs it so that the ceramic pins 7 can be prevented from cracking due to the torsional moment.

Figure 10:
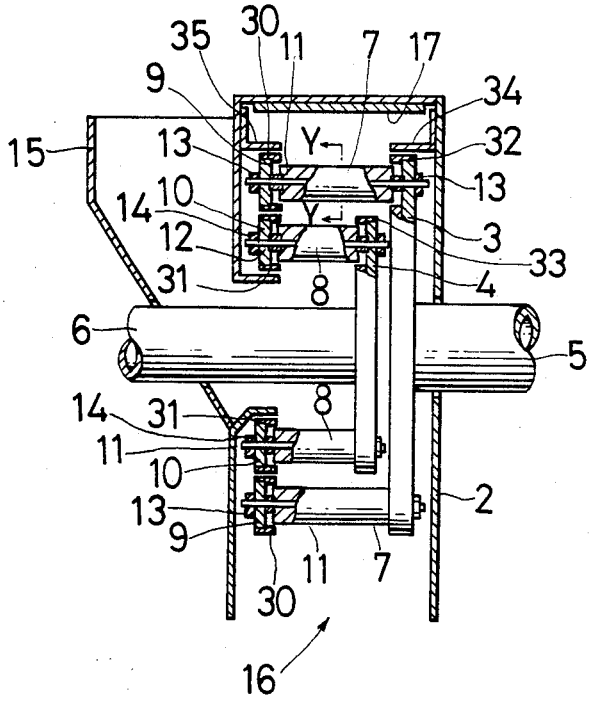
FIG. 10 is a vertical sectional view showing a cage mill according to still another embodiment of this invention.

The embodiment of FIG. 10 is similar to the embodiment of FIGS. 1 and 2 except the fact that ceramic linings 30, 31, 32, 33 cover the rings 9, 10 and the discs 3, 4.

The linings 30, 31 are formed in a ring shape and have a channel-shaped groove, corresponding to the configuration of the rings 9, 10. The rings 9, 10 are placed in the grooves of the linings 30, 31, respectively. The linings 32, 33 are formed substantially in a disc shape and have recess portions for receiving the discs 3, 4, respectively. That is, the linings 30 to 33 have a channel-shape or a L-shape in section corresponding to the configuration of the rings 9,10 and the discs 3,4 for covering an inner surface of the discs and the rings.

Figure 11:
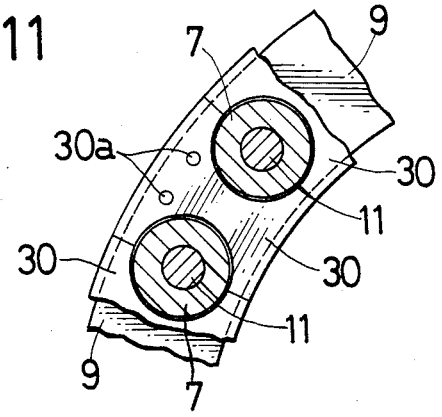
FIG. 11 is a sectional view taken along the Y—Y line of FIG. 10.
Figure 12:
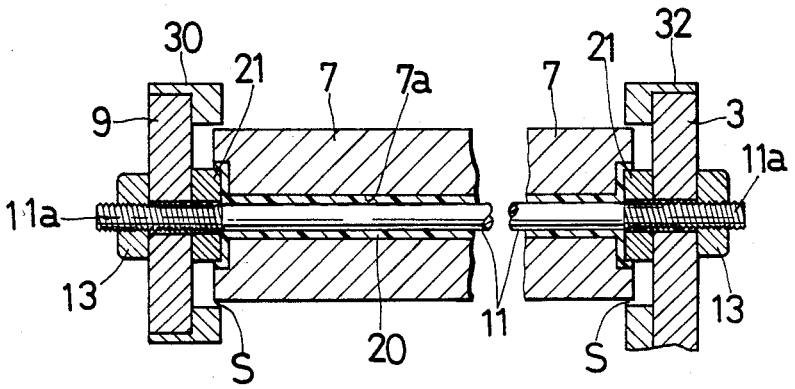
FIG. 12 is a sectional view showing a pin, its related members, a lining and its related members shown in FIG. 10.
Figure 13:
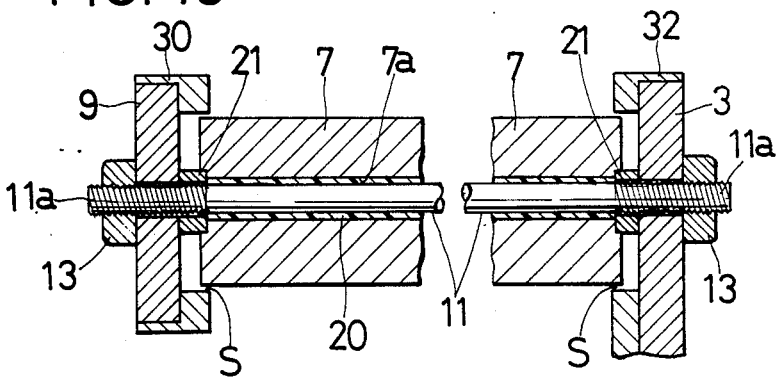
FIG. 13 is a sectional view showing a further embodiment of this invention, corresponding to FIG. 12.

In addition, the linings 30,33 have plural circular holes at regular intervals for arranging the ceramic pins 7, 8 as best shown in FIG. 11. A clearance S of 1 to 3 mm is formed between the ceramic pins 7, 8 and the linings 30 to 33.

In the embodiment of FIG. 10, all portions whic are impacted in crushing are covered by various members made of ceramics.

The linings 30 to 33 can be fixed by means of only the adhesive. As shown in FIG. 11, the linings 30 to 33 can be divided into plural sections which are fixed to the rings 9, 10 and the discs 3, 4 by means of adhesives. In addition to the adhesives, bolts can be used, for instance, for the purpose of securely fixing the lining 30 to the ring 9 by the bolts inserted through plural holes 30*a*. Each section of the linings 30 to 33 can be formed as a sector.

WORKING EXAMPLE

Figure 15:
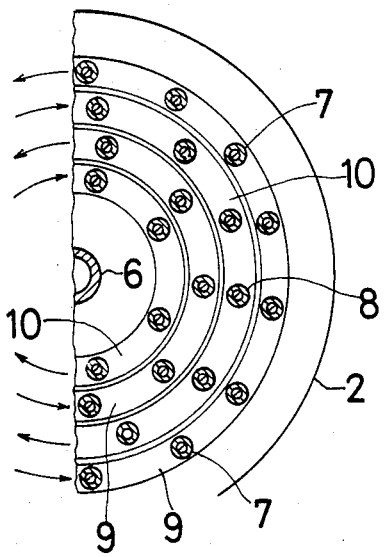
FIG. 15 is a schematic sectional view showing a four-cage type cage mill.
Figure 16:
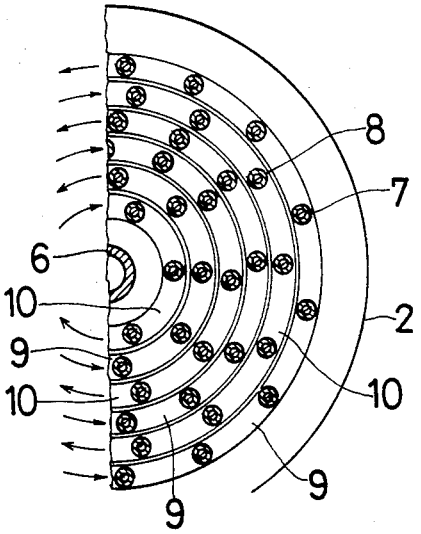
FIG. 16 is a schematic sectional view showing a six-cage type cage mill.

A cage mill having two large cages and two small cages is shown in FIG. 15. All ceramic pins 7, 8 are made of 96% $Al_2O_3$. The hard materials which are small pieces of stone having 5–15 mm are crushed by the cage mill thereby to become fine grains. The peripheral speed of the largest cage is 31 m/sec. The rotational speed of the cage mill is 525 r.p.m.

When the cage mill has crushed the hard materials of 11500 ton since starting, it is still possible to obtain desired sands. Thus, the ceramic pins 7, 8 are not required to be exchanged for new ones for a long time.

When the same hard materials are crushed by a conventional cage mill having high chrome pins to produce the same product, only 3850 tons of stones can be crushed in practice. The pins are decreased in diameter due to their wearing to such a degree that the pins must be exchanged for new ones from the safety viewpoint.

As can be seen from the foregoing, a cage mill according to this invention can be used for double period of time or more as compared with the prior art. According to this invention, a cage mill can provide excellent wear-resistance for significantly longer component life.

We claim:

1. A cage mill comprising:

a housing having an inlet at a side portion thereof and an exit at a lower portion thereof;

a disc rotatably supported within the housing;

a plurality of support shafts, each of the support shafts fixed at one end to the disc so as to form a cage into which hard materials can enter through the inlet of the housing as the cage rotates;

a ring fixed to the other end of each of the support shafts;

a plurality of ceramic pins each fixed by an adhesive to one of the support shafts; and stopper means for preventing the ceramic pins from directly contacting the disc and the ring.

2. A cage mill as defined in claim 1, further comprising first and second linings made of ceramics, the first and second linings being fixed to the disc and the ring for protecting the disc and the ring, respectively.

3. A cage mill as defined in claim 2, in which said second lining is an L-shape in section corresponding to the configuration of the ring.

4. A cage mill as defined in claim 3, wherein the second lining is divided into plural sections.

5. A cage mill as defined in claim 2, in which the first and second linings have holes for receiving the support shafts and wherein a clearance is formed between the first and second linings and each end of the ceramic pins at said holes.

6. A cage mill as defined in claim 1, in which a pair of discs, one small and one large, are arranged within the housing in such a manner that the discs rotate in opposite directions.

7. A cage mill as defined in claim 6, wherein the ceramic pins are made of a material selected from the group consisting of silicon nitride ($Si_3N_4$), aluminous porcelain and silicon carbide.

8. A cage mill as defined in claim 1, wherein each of the ceramic pins has a through-hole, through which a support shaft extends, and a recess formed at each end thereof for receiving a spacer disposed in each recess between a ceramic pin and the disc as well as in each recess between a ceramic pin and the ring so as to provide said stopper means and wherein adhesive is placed between each spacer and the ceramic pin.

9. A cage mill as defined in claim 1, wherein each of the ceramic pins has a through-hole, through which a support shaft extends and a recess formed at each end thereof for receiving a spacer detachably disposed in each recess between a the ceramic pin and the disc as well as in each recess between a ceramic pin and the ring so as to provide said stopper means.

10. A cage mill as defined in claim 1, wherein pipes are disposed between the ceramic pins and the support shafts, wherein the adhesive is placed between the ceramic pins and the pipes and wherein the pipes slightly project from the end surfaces of the ceramic pins and contact the disc and the ring so as to provide said stopper means.

11. A cage mill as defined in claim 1, wherein the support shafts have at both ends a reduced diameter portion on which a washer is placed so as to form the stopper means.

12. A cage mill as defined in claim 1, wherein pipes are provided between the support shafts and the ceramic pins, wherein the adhesive is placed between the ceramic pins and the pipes and wherein the pipes slightly protrude from the end surfaces of the ceramic pins so as to form the stopper means.

13. A cage mill in accordance with claim 12 wherein said disc and said ring both have a plurality of through-holes and further comprising a flanged sleeve member inserted into each of said through-holes, with one end of a support shaft extending through each of said sleeve members, the flange of said sleeve member serving to separate the ring or disc from the pipe mounted on the support shaft extending through said flanged sleeve member.

14. A cage mill as defined in claim 1, wherein the support shafts are each in the shape of a pipe and are internally threaded at both ends to provide female screw portions;

wherein the disc and ring are each provided with a plurality of internally threaded through-holes; and further comprising:

a bolt threaded through each through-hole of said ring and said disc and into one of said female screw portions so that said ring and said disc are fixed to a support shaft with a clearance thereby providing said stopper means.

* * * * *